US011834834B1

(12) United States Patent
Escher

(10) Patent No.: US 11,834,834 B1
(45) Date of Patent: Dec. 5, 2023

(54) ROOF FASCIA PROTECTION GUARD

(71) Applicant: Richard K. Escher, Thornton, CO (US)

(72) Inventor: Richard K. Escher, Thornton, CO (US)

( * ) Notice: Subject to any disclaimer, the term of this patent is extended or adjusted under 35 U.S.C. 154(b) by 48 days.

(21) Appl. No.: 17/809,724

(22) Filed: Jun. 29, 2022

(51) Int. Cl.
*E04D 13/15* (2006.01)
*E04D 13/158* (2006.01)
*E04D 13/064* (2006.01)

(52) U.S. Cl.
CPC ..... *E04D 13/158* (2013.01); *E04D 13/064* (2013.01)

(58) Field of Classification Search
CPC ..... E04D 13/064; E04D 13/158
See application file for complete search history.

(56) References Cited

U.S. PATENT DOCUMENTS 1,343,461 A 6/1920 Marberg
1,822,410 A * 9/1931 Macan ..... E04D 13/1585 428/101
2,434,185 A * 1/1948 Whitehouse ..... E04D 3/35 52/529
3,332,180 A * 7/1967 Price ..... E04D 13/1585 52/60
3,826,048 A 7/1974 Merkin et al.
4,109,428 A * 8/1978 Aarons ..... E04D 13/1585 52/95
4,233,786 A * 11/1980 Hildreth ..... E04D 13/1585 D25/140
4,909,006 A * 3/1990 Hickman ..... E04D 13/155 52/716.2
5,537,785 A 7/1996 Zaccagni
5,729,933 A 3/1998 Strength
5,950,375 A * 9/1999 Zaccagni ..... E04D 13/158 52/715
6,026,616 A 2/2000 Gibson
6,073,400 A * 6/2000 Balisle ..... E04D 13/0459 52/96
6,092,339 A 7/2000 Hall et al.
6,272,797 B1 * 8/2001 Finger ..... E04D 13/1585 52/60
6,301,840 B1 * 10/2001 Spinelli ..... E04D 13/158 52/717.03

(Continued)

FOREIGN PATENT DOCUMENTS

DE 450695 C * 10/1927
DE 4011524 A1 * 11/1990

(Continued)

*Primary Examiner* — Adriana Figueroa
(74) *Attorney, Agent, or Firm* — Cochran Freund & Young, LLC

(57) ABSTRACT

A roof fascia protection guard is intended for use in an architectural structure having a roof fascia intersecting an adjacent sloped roof to drain run-off water from an open end of the rain gutter. The roof fascia protection guard has a vertical surface covering only the end portion of a roof fascia adjacent to the open end of the gutter, with top and bottom edges extending along the top and bottom edges of the fascia. A tapered end extends upward from the bottom edge along the tapered end of the roof fascia and the sloped roof surface adjacent to the open end of the rain gutter. The roof fascia protection guard includes flanges along its bottom edge and tapered end to further protect the bottom of the fascia.

14 Claims, 2 Drawing Sheets

(56) References Cited

U.S. PATENT DOCUMENTS

| | | | | |
|---|---|---|---|---|
| 6,484,461 | B1 | 11/2002 | Schofield | |
| 7,059,086 | B2 | 6/2006 | Edvardsen | |
| 8,316,587 | B2 | 11/2012 | Shugart | |
| 10,450,756 | B2 * | 10/2019 | Owens | E04D 13/0641 |
| 10,774,537 | B2 | 9/2020 | Folkersen et al. | |
| 10,808,406 | B2 | 10/2020 | Folkersen et al. | |
| 11,266,142 | B1 * | 3/2022 | Bishop | E04D 13/004 |
| 2006/0070303 | A1 | 4/2006 | Burnet | |
| 2007/0193125 | A1 * | 8/2007 | Mehaffey | E04D 13/064<br>52/302.1 |
| 2016/0168859 | A1 | 6/2016 | Vargas | |

FOREIGN PATENT DOCUMENTS

| | | | | | |
|---|---|---|---|---|---|
| EP | 2840198 | A1 * | 2/2015 | | E04D 13/1585 |
| FR | 2899261 | A1 * | 10/2007 | | E04D 13/158 |
| FR | 3083555 | A1 * | 1/2020 | | |
| GB | 2164976 | A * | 4/1986 | | E04D 13/158 |
| GB | 2174124 | A * | 10/1986 | | E04D 1/30 |
| GB | 2204617 | A * | 11/1988 | | E04D 13/158 |

* cited by examiner

ROOF FASCIA PROTECTION GUARD

BACKGROUND OF THE INVENTION

Field of the Invention

The present invention relates generally to the field of roof fascias. More specifically, the present invention discloses a protection guard for cladding the end of the roof fascia adjacent to the open end of a rain gutter where water is discharged onto a lower roof surface.

Statement of the Problem

Roof fascias on single-family and multi-family residential projects, and on some commercial projects, are often constructed using a natural wood product, a composite wood fiberboard, or a fiber-cement board. These materials, with the exception of fiber-cement board, are highly susceptible to damage from exposure to water and must be protected. This is normally done by painting. Fiber-cement board is fabricated from cement and is therefore considerably more durable and can be provided with a pre-finish color or painted. Other fascia materials are available such as vinyl, steel, aluminum or even wood products laminated with one of these materials. However, these materials are more suitable for new construction, rather than projects scheduled to receive wood fascias or existing projects with painted fascias.

The area of the fascia most susceptible to damage is where an open-ended gutter terminates and water is discharged onto a lower sloping roof surface. The water discharged from the gutter deteriorates the finish and substrate of the adjacent fascia over a relatively short period of time. It can be very expensive to replace the entire fascia or cover the entire fascia with one of the weather-resistant materials described above. Therefore, a need exists for an economical fascia guard to protect this section of the roof fascia.

Solution to the Problem

The present invention provides a roof fascia protection guard with a tapered end to protect the end section of the roof fascia adjacent to the open end of a rain gutter where water is discharged onto a lower roof surface. The present invention provides a cost-effective means to prevent deterioration of the end section of the fascia, and also can be readily adapted for use in new construction or retrofitted to existing architectural structures.

SUMMARY OF THE INVENTION

This invention provides a roof fascia protection guard for use in an architectural structure having a roof fascia intersecting an adjacent sloped roof to drain run-off water from an open end of the rain gutter. The roof fascia protection guard has a vertical surface covering only the end portion of a roof fascia adjacent to the open end of the gutter, with top and bottom edges extending along the top and bottom edges to match the fascia. A tapered end extends upward from the bottom edge along the tapered end of the roof fascia and the sloped roof surface adjacent to the open end of the rain gutter. The roof fascia protection guard includes flanges along its bottom edge and tapered end to further protect the bottom of the fascia.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
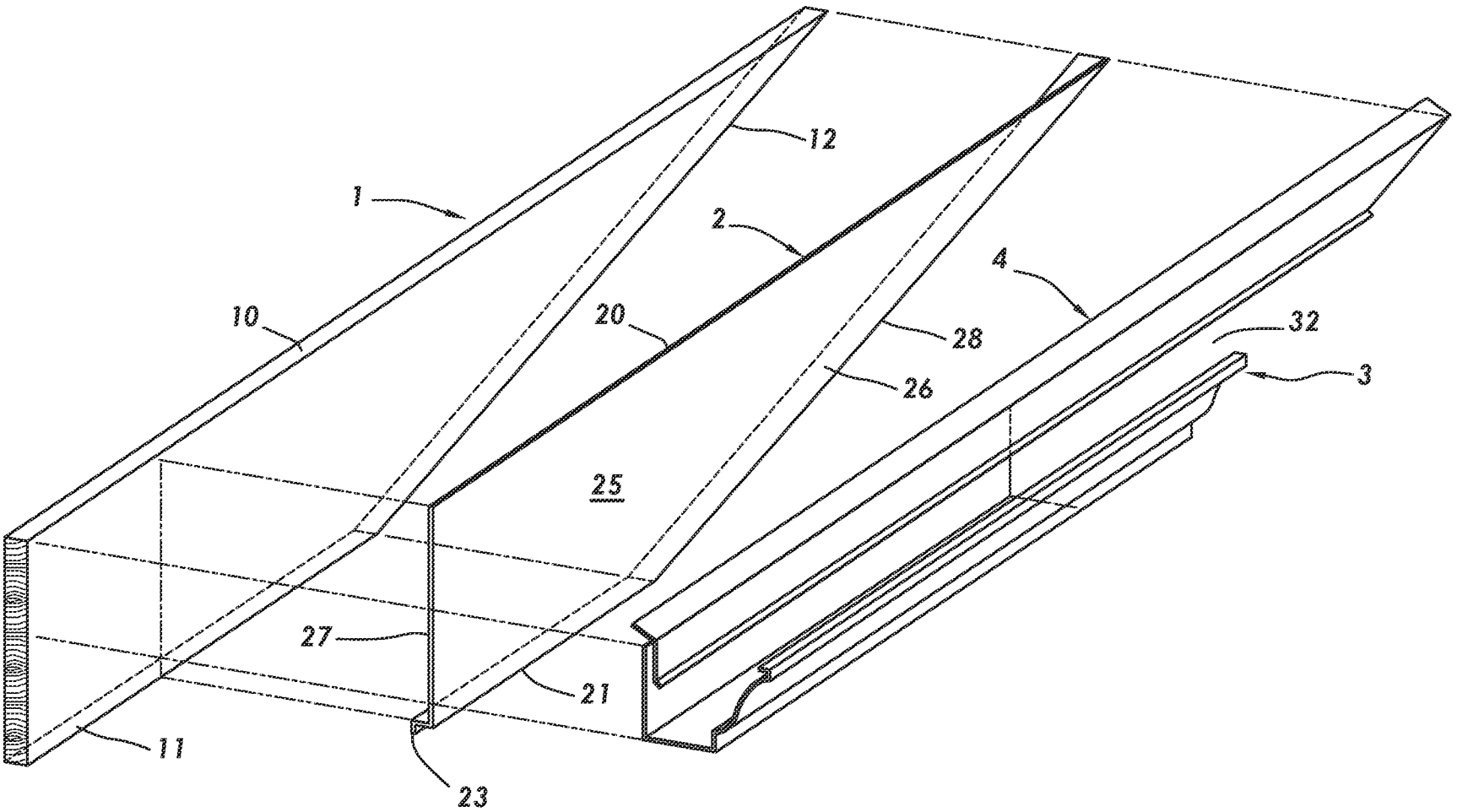
FIG. 1 is an exploded perspective view illustrating the assembly of a partial roof fascia 1, roof fascia protection guard 2, rain gutter 3 and metal counter-flashing 4.
Figure 2:
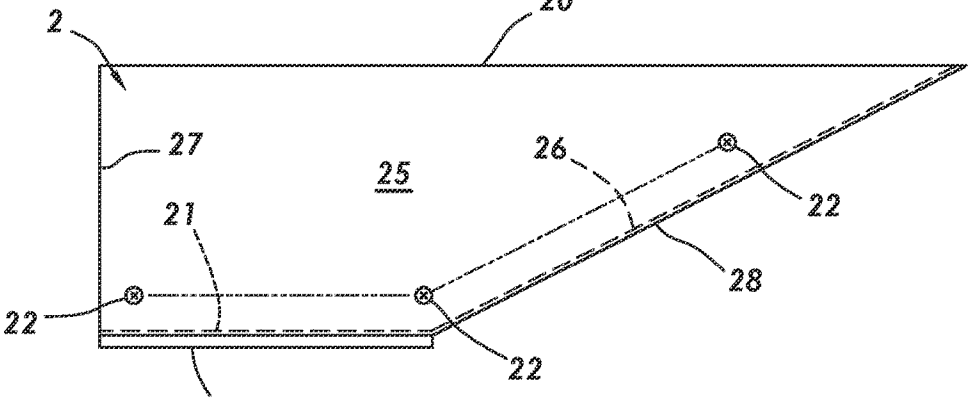
FIG. 2 is a side elevation view of the roof fascia protection guard 2.

Turning to FIG. 1, an exploded perspective view is provided illustrating the assembly of the roof fascia protection guard 2 on a partial roof fascia 1 with a rain gutter 3 and metal counter-flashing 4. FIG. 2 is a corresponding side elevation view of the roof fascia protection guard 2. The roof fascia protection guard 2 is a metal cover applied over the end of a new or existing roof fascia 1 to prevent water from deteriorating the exposed paint finish and the roof fascia 1 itself.

Figure 3:
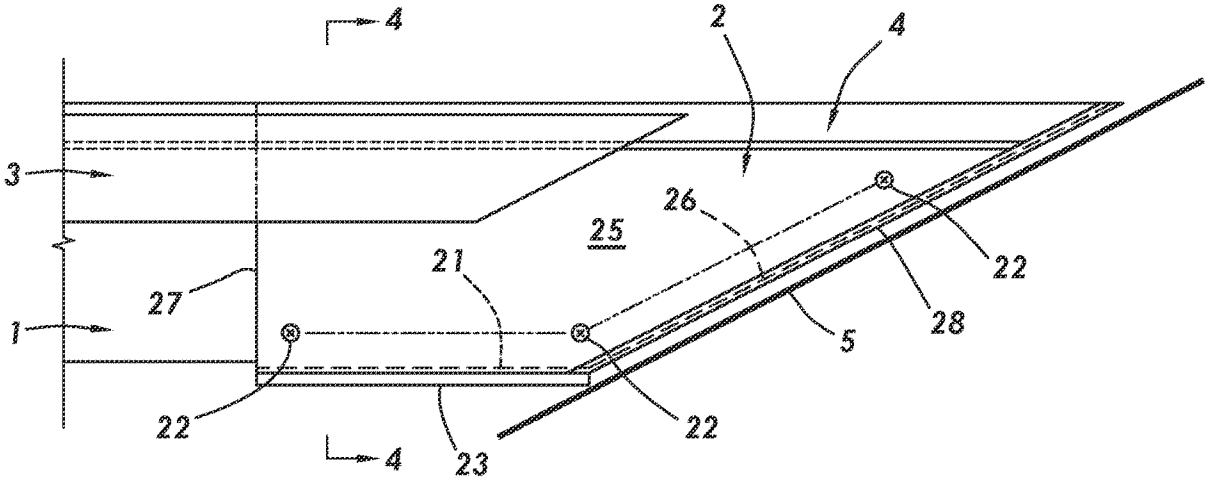
FIG. 3 is a side elevation view of the assembly of a partial roof fascia 1, roof fascia protection guard 2, rain gutter 3 and metal counter-flashing 4, also showing the sloping roof surface 5.

As shown in FIG. 3, the roof fascia protection guard 2 is primarily intended for use in an architectural structure having a roof fascia 1 extending horizontally with a rain gutter 3 that intersects an adjacent sloped roof 5 to drain run-off water from the open end 32 of the rain gutter 3. The roof fascia 1 typically has horizontal top and bottom edges 10, 11 and a tapered end 12 running diagonally upward from the bottom edge 11 along the sloping roof surface 5

The vertical surface 25 of the roof fascia protection guard 2 covers only the end portion of a roof fascia 1 adjacent to the open end 32 of the rain gutter 3. This vertical surface 25 includes a top edge 20 extending along the top edge 10 of the roof fascia 1. Its bottom edge extends along the bottom edge 11 of the roof fascia 1. A first end 27 of the vertical surface 25 extends between the top edge 10 and bottom edge 11 of the roof fascia 1. The height of the roof fascia protection guard 2 is determined by the height of the roof fascia 1. Roof fascias are generally constructed of 1×8 (¾"×7¼" actual) materials. However, the roof fascia protection guard 2 can be manufactured to standard material sizes or custom fabricated to project-specific roof fascias.

A tapered second end 28 opposing the first end 27 of the roof fascia protection guard 2 extends diagonally upward from the bottom edge along the tapered end 12 to the top edge 10 of the roof fascia 1 adjacent to the open end 32 of the rain gutter 3 and sloped roof surface 5, as illustrated in FIG. 3. The top edge 20 and tapered second end 28 of the roof fascia protection guard 2 define a tapered section of the vertical surface 25 covering the fascia 1 between the sloped roof surface 5 and the rain gutter 3. The angle or slope of the tapered second end 28 is determined by the project-specific slope of the roof surface 5. Roof slopes are generally a 3:12, 4:12 or 6:12 slope and the roof fascia protection guard 2 can be manufactured to these roof slopes or custom fabricated for project-specific roof slopes. The total horizontal length of the roof fascia protection guard 2 (i.e., the distance between the first end 27 and the tapered second end 28) should be selected so that the tapered second end 28 extends beyond the open end 32 of the rain gutter 3. The first end 27 should be located at a sufficient distance to protect the roof fascia 1 from water discharged by the gutter 3.

A bottom flange 21 extends along the bottom edge of the roof fascia protection guard 2 to substantially cover the bottom edge 11 of the roof fascia 1 and provide protection from potential exposure to moisture. A tapered end flange 26 also extends along the tapered end 28 of the roof fascia protection guard 2 to cover the tapered end 12 of the roof fascia 1. The roof fascia protection guard 2 can be manufactured with standard flange widths or custom fabricated to project specific requirements.

The bottom horizontal flange 21 can be provided with small weep holes to assist in eliminating any water that may accumulate between the bottom 11 of the roof fascia 1 and the bottom horizontal flange 21.

A drip edge 23 is added along the bottom horizontal flange 21. This drip edge 23 prevents water from potentially wicking up between the bottom 11 of the roof fascia 1 and the bottom horizontal flange 21.

The roof fascia protection guard 2 is designed to be manufactured by fully automated procedures and can be readily fabricated as a single piece from suitable material. The material used for the roof fascia protection guard 2 should be corrosion resistant. Sheet aluminum or galvanized steel is appropriate. Stainless steel is an option but more expensive. If the roof fascia protection guard 2 is made of aluminum, it could be produced with a milled finish. If the fascia guard 2 is made of galvanized steel, it could be left unpainted. Alternatively, the fascia guard 2 can be primed and painted to match the color of the roof fascia 1 or a custom color. Optionally, a temporary protective covering or film can be applied to the metal after manufacturing and removed after the roof fascia protection guard 2 has been installed.

Figure 4:
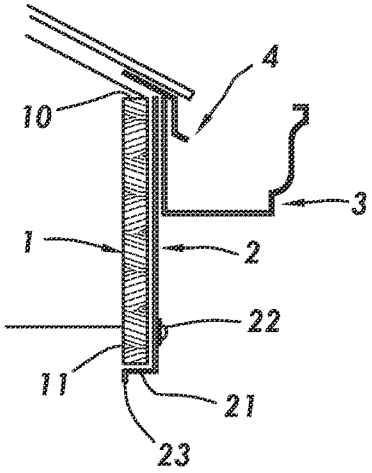
FIG. 4 is a cross-sectional view of the assembly taken along lines 4-4 in FIG. 3.

For a new roof fascia 1, the roof fascia protection guard 2 can be applied prior to installation of the roof gutter 3 and roof counter-flashing 4. For an existing roof fascia 1, the roof fascia protection guard 2 can be applied by sliding it under the roof gutter 3 and counter-flashing 4 until it reaches the top of the fascia 1 and the bottom horizontal flange 21 and tapered end flange 26 are in full contact with the roof fascia 1, as shown in the cross-sectional view illustrated in FIG. 4.

The roof fascia protection guard 2 can be secured to the roof fascia 1 by any of a variety of means. The roof fascia protection guard 2 can be equipped with a number of holes 22 to receive screws, nails or other fasteners. For example, conventional corrosion-resistant metal screws can be used to secure the roof fascia protection guard 2 to the roof fascia 1. A clear sealant can be applied at the penetration to prevent water intrusion.

An adhesive could be used to bond the roof fascia protection guard 2 to the fascia 1. A bead of sealant can be applied to the backside of the roof fascia protection guard 2 or directly to the roof fascia 1 along the exposed first end 27 of the roof fascia protection guard 2 to prevent water intrusion.

An alternative method of securing the roof fascia protection guard 2 would be to apply a double-sided tape (e.g., 3M VHB tape) to the backside of the metal. Prior to application of the roof fascia protection guard 2, the installer would remove the release paper from the tape and press the roof fascia protection guard 2 on to the roof fascia 1. This method may be more appropriate with new roof fascia 1 construction.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

I claim:

1. A roof fascia protection guard for use in an architectural structure having a roof fascia extending horizontally with a rain gutter and intersecting an adjacent sloped roof surface to drain run-off water from an open end of the rain gutter; said roof fascia having top and bottom edges and a tapered end running upward from the bottom edge along the roof surface; said roof fascia protection guard comprising:

a vertical surface for covering only the end portion of the roof fascia adjacent to the open end of the rain gutter; a top edge extending along the top edge of the roof fascia; a bottom edge extending along the bottom edge of the roof fascia; a first end extending between the top edge and the bottom edge of the roof fascia; and a tapered second end opposing said first end and extending upward from the bottom edge along the tapered second end to the top edge of the roof fascia adjacent to the open end of the rain gutter and the sloped roof surface.

2. The roof fascia protection guard of claim 1 wherein said top edge and said tapered second end of the roof fascia protection guard define a tapered section of the vertical surface covering the roof fascia between the sloped roof surface and the rain gutter.

3. The roof fascia protection guard of claim 1 further comprising a bottom flange extending along the bottom edge of the roof fascia protection guard to substantially cover the bottom edge of the roof fascia.

4. The roof fascia protection guard of claim 3 further comprising a drip edge extending along the bottom flange.

5. The roof fascia protection guard of claim 1 further comprising a tapered end flange extending along the tapered end of the roof fascia protection guard to substantially cover the tapered end of the roof fascia.

6. The roof fascia protection guard of claim 1 further comprising a plurality of holes through the vertical surface for receiving fasteners to secure the roof fascia protection guard to the roof fascia.

7. The roof fascia protection guard of claim 1 wherein the roof fascia protection guard is secured to the roof fascia with adhesive.

8. The roof fascia protection guard of claim 1 further comprising sealant applied along the first end of the roof fascia protection guard and the roof fascia.

9. A roof fascia protection guard for use in an architectural structure having a roof fascia extending horizontally with a rain gutter and intersecting an adjacent sloped roof surface to drain run-off water from an open end of the rain gutter; said roof fascia having top and bottom edges and a tapered end running upward from the bottom edge along the roof surface; said roof fascia protection guard comprising:

a vertical surface for covering only the end portion of the roof fascia adjacent to the open end of the rain gutter; said vertical surface having:

(a) a top edge extending along the top edge of the roof fascia; (b) a bottom edge extending along the bottom edge of the roof fascia; (c) a first end extending between the top edge and the bottom edge of the roof fascia; and (d) a tapered second end opposing said first end and extending upward from the bottom edge along the tapered second end to the top edge of the roof fascia adjacent to the open end of the rain gutter and the sloped roof surface; and a bottom flange extending along the bottom edge of the roof fascia protection guard to substantially cover the bottom edge of the roof fascia; and a tapered end flange extending along the tapered end of the roof fascia protection guard to substantially cover the tapered end of the roof fascia.

10. The roof fascia protection guard of claim 9 wherein said top edge and said tapered second end of the roof fascia protection guard define a tapered section of the vertical surface covering the roof fascia between the sloped roof surface and the rain gutter.

11. The roof fascia protection guard of claim 9 further comprising a drip edge extending along the bottom flange.

12. The roof fascia protection guard of claim 9 further comprising a plurality of holes through the vertical surface for receiving fasteners to secure the roof fascia protection guard to the roof fascia.

13. The roof fascia protection guard of claim 9 wherein the roof fascia protection guard is secured to the roof fascia with adhesive.

14. The roof fascia protection guard of claim 9 further comprising sealant applied along the first end of the vertical surface and the roof fascia.

* * * * *